United States Patent [19]

Németh et al.

[11] Patent Number: 4,626,031

[45] Date of Patent: Dec. 2, 1986

[54] APPARATUS FOR LOOSENING AND/OR BREAKING COAL DEPOSITS, ROCKS, GRANULAR OR LUMPY MATERIAL, OR SCRAP

[75] Inventors: József Németh; László Belley, both of Budapest; György Gergö; Béla Sebestyén, both of Pécs; Zoltán Vida, Komló, all of Hungary

[73] Assignees: Gepipari Technologiai Intezet; Mecseki Szenbanyak, both of Budapest, Hungary

[21] Appl. No.: 684,976

[22] Filed: Dec. 21, 1984

Related U.S. Application Data

[63] Continuation of Ser. No. 476,521, Mar. 18, 1983, abandoned.

[30] Foreign Application Priority Data

Aug. 4, 1982 [HU] Hungary ..... 2511/82

[51] Int. Cl.[4] ..... E21C 37/14

[52] U.S. Cl. ..... 299/16; 102/330

[58] Field of Search ..... 299/16, 20; 239/101, 239/102, 99, 563; 181/106, 118, 119; 367/81; 175/67; 166/298; 102/325-330

[56] References Cited

U.S. PATENT DOCUMENTS

| | | | |
|---|---|---|---|
| 3,098,442 | 7/1963 | Wakefield et al. | 102/330 |
| 4,108,272 | 8/1978 | Paitson et al. | 181/18 |
| 4,301,731 | 11/1981 | Fitzgerald | 102/330 |

FOREIGN PATENT DOCUMENTS

| | | | |
|---|---|---|---|
| 644940 | 8/1940 | Fed. Rep. of Germany | 102/325 |

*Primary Examiner*—Stephen J. Novosad
*Assistant Examiner*—Michael A. Goodwin
*Attorney, Agent, or Firm*—Karl F. Ross; Herbert Dubno

[57] ABSTRACT

An apparatus for breaking coal or other mineral matter from a bed thereof which comprises a string filling a bore hole which can rise steeply in this bed. The string consists of alternating breaking units and connecting pipes each braking unit having a differential piston displaced solely by the action of air pressure so that breaking slots are unblocked to discharge compressed air built up in the string. The pistons are provided with check valves to permit filling of the string.

1 Claim, 4 Drawing Figures

APPARATUS FOR LOOSENING AND/OR BREAKING COAL DEPOSITS, ROCKS, GRANULAR OR LUMPY MATERIAL, OR SCRAP

This is a continuation of co-pending application Ser. No. 476,521, filed on Mar. 18, 1983, now abandoned.

FIELD OF THE INVENTION

This invention relates to a method of and an apparatus for loosening and breaking coal deposits by high pressure compressed-air breaking cylinders.

BACKGROUND OF THE INVENTION

In the case of geologically disturbed, methane-containing coal deposits which have small dimensions and which are of high strength, mechanical mining has not yet been perfected. In coal mines working under these conditions, the applied method, apart from manual loosening, is mainly by short hole loosening and/or breaking by a single breaking cylinder, functioning with high pressure compressed air. The conventional compressed-air breaking cylinder is fundamentally a bevel end hollow cylinder with breaking-air slots or apertures on the circumference, to which a high pressure compressed air duct is joined by the intermediary of a crack disk. At the present time in coal mining, the conventional single cylinder breaking unit is fed from an air duct with a maximum pressure of 100 $MN/m^2$. In the case of such units the breaking length or depth is 1–2 m per operation in plain coal deposits and a maximum 6 m in steep dip coal deposits. In plain coal beds the breaking depth is increased by a multistep slow operation with consecutive breaking sections of 1–1.5 m length, while in steep dip coal beds, applying tearing down of top coal without support, this is impossible, because the top wall over the broken area tears away in mose cases. When the breaking holes are bored longer than as stated above, and in the bottom of a hole a single cylinder breaking unit is actuated, then a loosening and/or breaking effect will not be attained in spite of the operation of the cylinder and only a compaction will be brought about. For applying an explosive procedure, the periodical evacuation of the air passage is obligatory.

The disadvantages of present methods are the small breaking length, low productivity, and the fact that for loosening and/or breaking steep dip, gaseous deposits when applying tearing down of top coal without support, these methods have only low productivity and, on account of tearing away of the top wall, also result in high losses of coal resources.

Moreover, the conventional breaking cylinders with a crack disk have the disadvantage in that the coal is broken by the air over the total circumference of the cylinder and so with low efficiency.

OBJECTS OF THE INVENTION

It is an object of the present invention to provide improved mining apparatus for the purposes described which raises the productivity, reduces the losses in coal resources, and enables the safe and full mechanized mining of geologically disturbed, folded, gaseous coal deposits without the evacuation of the air passage.

It is another object of the invention to increase the loosening or breaking length of an operation in such a manner, that the loosening of the coal and the removal of the loosened coal mass will be facilitated. Likewise, it is an important object to increase the effectiveness of loosening.

SUMMARY OF THE INVENTION

The invention is based upon our discovery that upon the boring of a long hole in the coal bed and the use of breaking eqipment in this bore which consist of breaking cylinders operating from the mouth to the bottom of this bore, in rapid succession with self-controlled delay, one with another, the breaking length can be increased and as a consequence, productivity can be raised by the step-by-step or unit-by-unit discharge of these units.

The productivity is raised because the air escaping from the breaking cylinder will be concentrated directly on the coal to be loosened and need not exercise any effect in the direction of the further, subsequent discharges, but will bring about an efficient loosening on the opposite side, on the layer just to be broken.

Therefore, the substance of the method according to the invention is the distribution of the loosening or breaking effect by high-pressure compressed air along the hole bored in the coal bed with a slight self-controlled retardation in the discharge rate along the pipe tracts. The breaking length can be manifold as compared with the length of the breaking unit according to the invention because of the retardation, every breaking cylinder functioning under favorable loosening circumstances as a result of the loosening brought about by the adjacent or contiguous breaking cylinder toward the side of the hole mouth.

Therefore, in the case of steep dip coal beds, the breaking length can be equal to the full length of the bore and these coal deposits can be worked-out safely and extraordinarily economically, applying tearing-down of the coal top, without support, with high productivity and minimum loss in coal resources, without evacuation of the air tract.

To carry out this method according to the invention, a self-controlled breaking apparatus with multiple breaking cylinders must be used. This equipment contains breaking sets which are suitable for filling the full length of the bore, and each breaking set consists of a pipe tract of a suitable length of 1–2 m and a breaking cylinder, connected by a thread to the pipe tract.

Thus, in the breaking equipment, a breaking cylinder and a pipe tract form a mating breaking set combined by the thread connection. The pipe tract as an air reservoir accumulates the high-pressure compressed air for loosening and/or breaking, while the breaking cylinder has in its jacket a suitably directed breaking-air slot and it contains a self-controlling piston. In the breaking cylinder there is a clearance for the axially movable piston. This piston controls the opening and the closing of the breaking-air slot and has a back-pressure valve for gradually filling the breaking sets, while for the step-by-step discharging of the breaking air, it is formed as a differential piston, with a different area of effective surface on its two ends.

The breaking-air slot is an opening in the cylinder jacket, for outflow of the high-pressure compressed air that, in contrast to the air slot of the conventional breaking cylinder, does not extend the total circumference of the cylinder and so it displays its effect to the coal bed only on the opposite side to advancing direction.

Thus, the breaking equipment according to the invention consists of n breaking sets, and the row of the connected breaking sets fills the full length of the hole bored in the coal bed. The discharging of the high-pressure breaking air runs along the bore in a split second sequence controlled by the pistons which enter into the function in the breaking cylinders with a slight delay, while the outflow of the compressed air is concentrated at the coal layer to be loosened.

The breaking sets formed by high-pressure tubular pipe tract reservoirs and compressed air breaking cylinders with self-controlling pistons provide breaking air available along the full length of the hole bored in the coal bed and the self-controlling pistons provide efficient breaking gradually by sections.

BRIEF DESCRIPTION OF THE DRAWING

The invention will now be described in greater detail by way of example, with reference to the accompanying drawing, in which.

SPECIFIC DESCRIPTION

Figure 1:
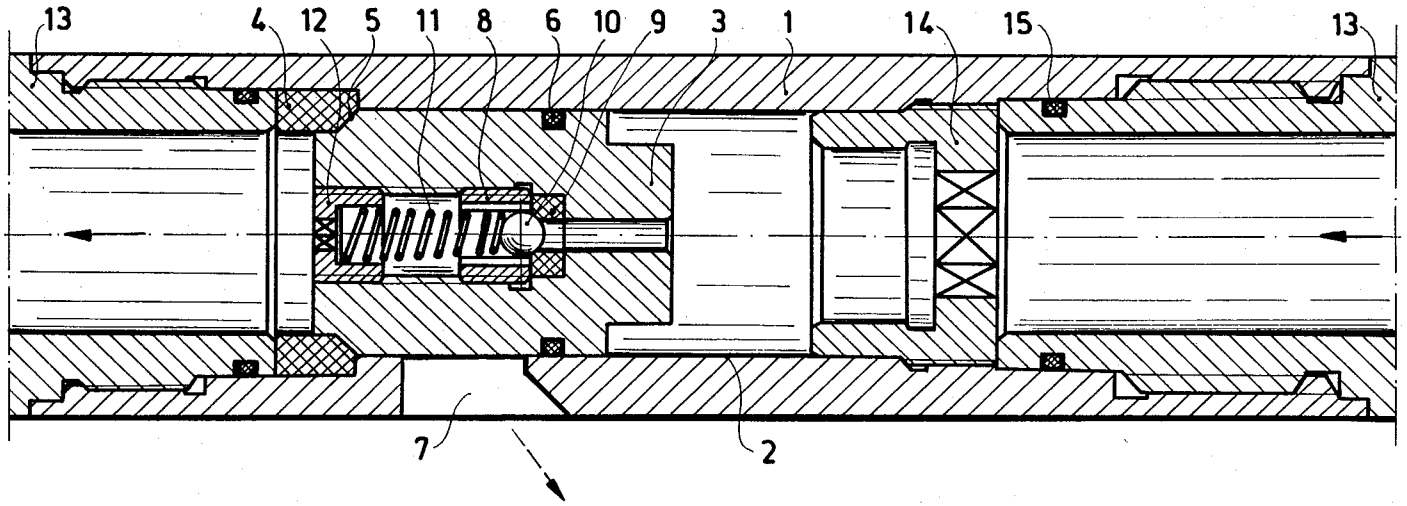
FIG. 1 is a section of a breaking cylinder, according to the invention

Referring now to FIG. 1 there is a clearance 2 formed in a breaking cylinder 1, and in this clearance 2 an opening-closing differential piston 3 is arranged, the sealing of which is provided by its frustoconical sealing end surface 5, joined to a lock collar 4 and by a packing ring 6.

In the jacket of the breaking cylinder 1, there is a breaking-air slot 7 formed, that comprises an arc of about 90 to 120° on the circumference and that is directed downwards at an angle of about 45° on the side of the coal stratum to be broken.

Within the piston 3 a back-pressure valve is arranged to determine the flow direction, comprising a ball 10 engaging a seat 9, that is fastened by a ball guide screw 8. A spring 11 presses the ball 10 against the seat 9 and is held by a screw 12, threaded in the piston 3. The lock collar 4 arranged in the breaking cylinder 1 is fastened by a pipe tract 13. On the lower, inflow side of breaking cylinder 1, a pressure-brake ring 14 is threaded to prevent the surface bruising or the jamming of the piston 3 during its opening. The breaking cylinder 1 or cylinders $1_l \ldots 1_n$ are directly connected by thread with pipe tracts $13_l \ldots 13_n$, respectively. These pipe tracts $13_l \ldots 13_n$ serve as independent air reservoirs connecting the breaking cylinders 1, while between them packing rings 15 provide the necessary sealing.

The engagement of breaking cylinder 1 and pipe tract 13 can be facilitated by the provision of a threaded joint.

Figure 2:
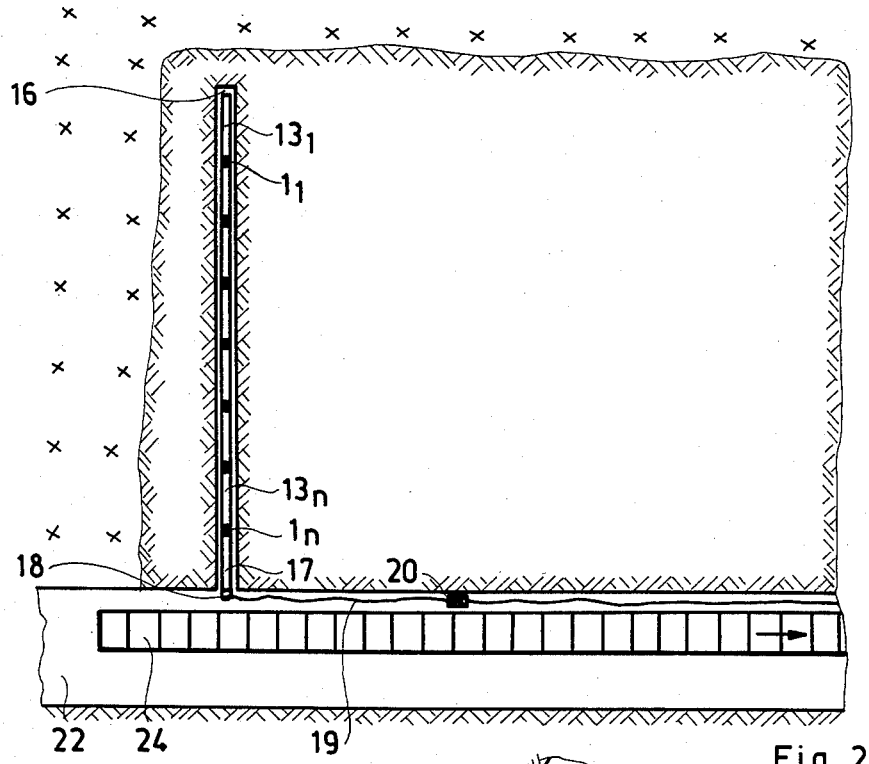
FIG. 2 is a plan view of the breaking equipment arranged in a steep dip coal bed ($\alpha > 50°$)
Figure 3:
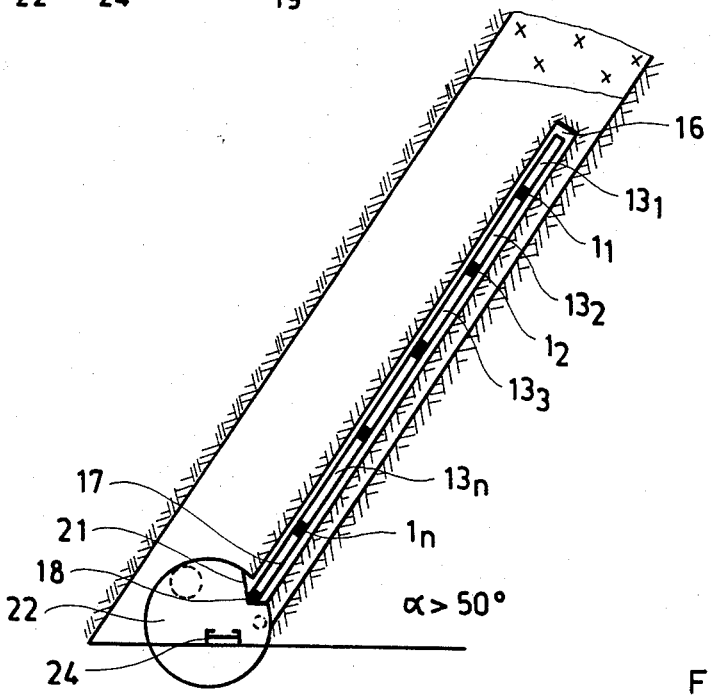
FIG. 3 is a side view of the arrangement seen in FIG. 2.
Figure 4:
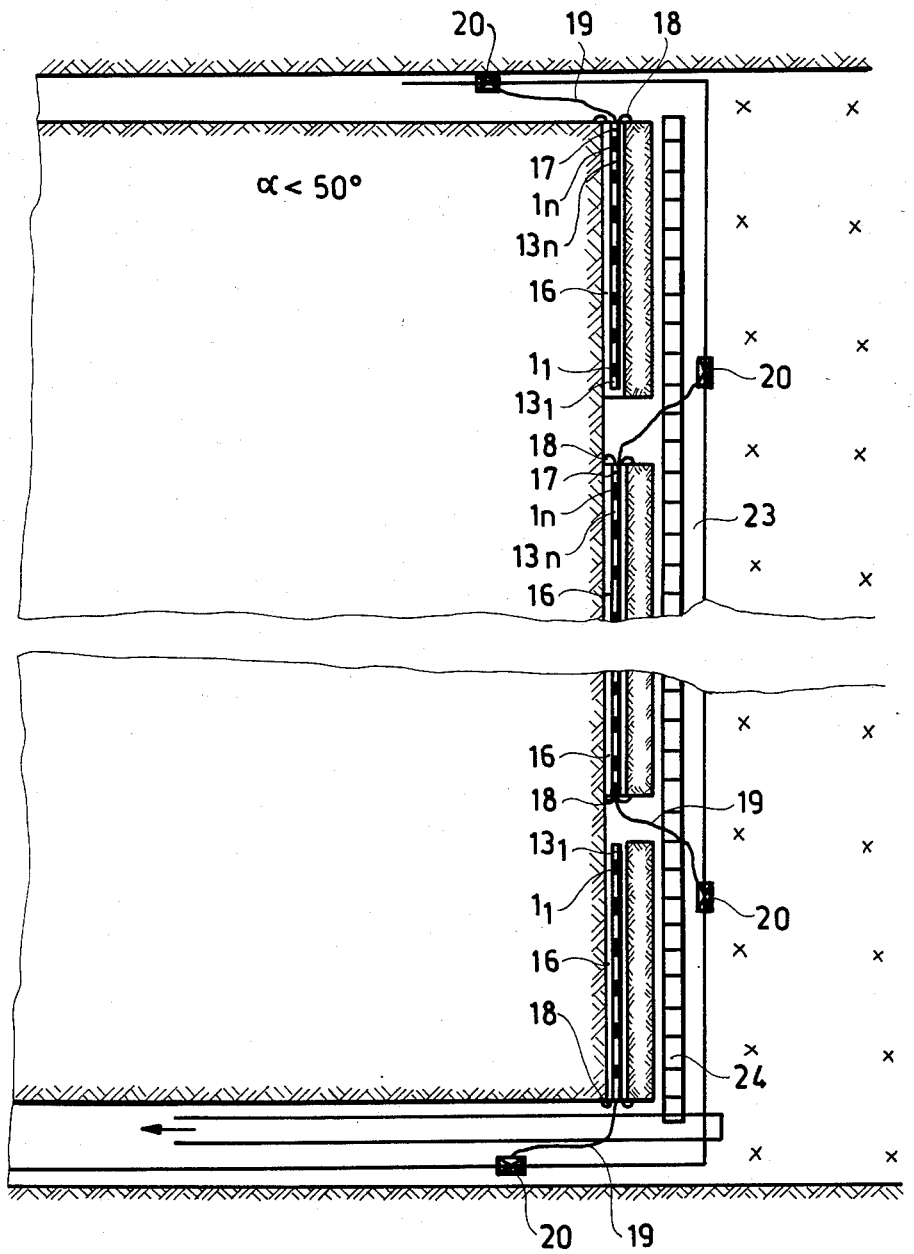
FIG. 4 is a plan view of the breaking equipment according to the invention, arranged in a plain coal bed ($\alpha > 50°$).

FIGS. 2 to 4 illustrate coal deposits prepared for breaking, wherein the breaking unit is introduced into a hole 16 bored in the coal bed. In these Figures, the breaking cylinders $1_1, 1_2 \ldots 1_n$ and the adjacent pipe tracts $13_1, 13_2 \ldots 13_n$ are shown. A starting valve or starting section 18 is inserted in a starting pipe 17 placed at the mouth of the bored hole 16. The whole breaking apparatus is combined with a refilling valve 20 by means of a flexible pipe 19. The assembled equipment is attached to the support of the gallery 22 or stope 23 by a chain 21. A chain conveyor 24 provides transport for the broken coal mass.

By means of the above described breaking equipment, the method according to the invention can be accomplished as follows:

In the case of steep dip coal deposits in the gallery (FIGS. 2 and 3), in the case of plain coal deposits in the stope (FIG. 4) or in separately developed trenchings as assembly setups, a boring apparatus is arranged in front of the coal face. The longitudinal hole or holes 16 are bored in the coal face with a length corresponding to the projected length of breaking, by means of a hand drilling head or frame drilling machines and extension bore rods. The sub-assembled breaking sets, consisting of pipe tract $13_1$, breaking cylinder $1_1$, pipe tract $13_2$, breaking cylinder $1_2$ etc. are moved by sections into the bore 16, by hand driving or power actuating. After pushing the first breaking set and before pushing the second or whichever next set respectively, this second (next) set will be screwed into the sets pushed before in the bore 16. Thus, the operations of screw connection and pushing will be repeated until the bore 16 is filled. Then, the starting pipe tract 17 with the starting valve or section 18 will be threaded onto the last breaking cylinder $l_n$ and the whole assembly will be connected to the support of the gallery 22 or stope 23, by means of the chain 21. Then the whole apparatus will be connected by means of flexible pipe 19 to the refilling valve 20 which closes and opens the high-pressure compressed air source.

Then the operating personnel remove themselves, that is, withdraws to the refilling valve 20 arranged at a place of safety. Now, the refilling valve 20 will be opened and the high pressure ompressed air flows through the flexible pipe 19 into the starting pipe tract 17 and further into the first, lowest breaking cylinder $1_n$. The compressed air drives the piston 3 to the lock collar 4, while the piston 3 closes the breaking-air slot 7, as indicated in FIG. 1. When the pressure of compressed air in the starting pipe tract 17 and breaking cylinder $1_n$ amounts to the pre-set value(preferably 0.3–0.5 $MN/m^2$), which is necessary for opening the back-pressure valve consisting of elements 8–12, the back-pressure valve opens by a drop in pressure in starting pipe 17 and the compressed air flows gradually to the neighboring pipe tract $13_n$ and further to the next breaking cylinder $1_{n-1}$. Thus, the operation of discharge, opening the back-pressure valve, flowing into the next set, etc. will repeat according to the above described order, until the discharge of the highest or most remote last pipe tract $13_1$, that is the whole breaking unit.

When the pressure amount to the value necessary, the starting valve or section 18 opens and the compressed air from the starting pipe tract 17 flows into the coal face or into the open air. In the course of rapid emptying of the starting pipe tract 17, the high-pressure air compressed in the pipe tract reservoir $13_n$ above this tract 17 pushes back the piston 3 located in the breaking cylinder $1_n$, situated between starting pipe tract 17 and pipe tract $13_n$. The piston 3 opens the breaking-air slot 7, and the high-pressure compressed air flows at high speed into the hole 16 bored in the coal face, performing the loosening and/or breaking operation. The procedure will be accomplished in the above described manner in every breaking cylinder $1_n$–$1_1$. The broken worked-out coal mass will be transferred on the chain conveyor 24 or other transport means.

The method and equipment according to the invention can be applied not only in coal beds, but also in connection with other rocks, granular or lumpy materials or scrap.

We claim:

1. An apparatus for loosening mineral matter from a bed thereof and particuarly along a steep front provided with a bore hole, said apparatus comprising:

a multiplicity of identical axially spaced-apart breaking units, each of said breaking units consisting of:

a housing defining an axial bore having an inlet end and an outlet end for compressed air, a free-floating differential piston displaceable in said bore axially between a first limiting position wherein said piston is proximal to said inlet end and a second limiting position wherein said piston is proximal to said outlet end, said piston being configured such that oppositely effective surfaces thereof subjected to pneumatic pressure solely result in the displacement of said piston between said limiting positions, the larger effective surface upon pressurization biasing said piston into said second limiting position, and a spring biased check valve wholly located in said piston and movable therewith and oriented to open upon flow of air under pressure from said inlet end to said outlet end by said flow of air when said piston is in said second limiting position and permitting flow of air under pressure through said piston when said piston is in said second position and blocking reverse flow of air through said piston, said housing being formed with a braking air slot opening laterally toward said mineral matter, blocked by said piston in said second limiting position and unblocked upon movement of said piston to said first limiting position;

respective identical connecting pipes between the housings of said units with each connecting pipe threadedly engaging the outlet end of each relatively more upstream unit adjacent the respective connecting pipe and threadedly engaging the inlet end of the adjacent relatively more downstream unit whereby said pipes and said units define a string substantially filling said bore hole and having an upstream end; and means for connecting said upstream end of said string to a high pressure compressed air source, whereby said units are successively filled with compressed air under high pressure and the respective pistons are urged by the high pressure into the respective second limiting positions and upon relief of pressure at said inlet end of said string by differential piston action said pistons are successively and automatically displaced into the respective first limiting positions to discharge air under high pressure in succession from the slots of said units with delay between the successive pressure discharges, said slots being limited to sides of said housings turned toward said mineral matter to be loosened and away from said bed, each of said housings being provided with only a single such slot, a locking collar being secured in said outlet end of each housing for sealing engagement by the respective piston and is held in the respective outlet end by a portion of an adjoining one of said connecting pipes threaded into the respective outlet end.

* * * * *